US006112376A

United States Patent [19]

Akashi et al.

[11] Patent Number: 6,112,376

[45] Date of Patent: Sep. 5, 2000

[54] SEPARABLE BOTTOM STOP ASSEMBLY OF CONCEALED SLIDE FASTENER

[75] Inventors: Shunji Akashi; Shigeyoshi Takasawa, both of Toyama-ken, Japan

[73] Assignee: YKK Corpration, Tokyo, Japan

[21] Appl. No.: 09/199,299

[22] Filed: Nov. 25, 1998

[30] Foreign Application Priority Data

Nov. 28, 1997 [JP] Japan ..... 9-328005

[51] Int. Cl.[7] ..... A44B 19/38

[52] U.S. Cl. ..... 24/433; 24/388; 24/432

[58] Field of Search ..... 24/433, 434, 432, 24/435, 418, 387, 388, 389

[56] References Cited

U.S. PATENT DOCUMENTS

| | | | |
|---|---|---|---|
| 3,046,627 | 7/1962 | Morin . | |
| 3,224,061 | 12/1965 | Taylor | 24/433 |
| 4,244,087 | 1/1981 | Akashi | 24/433 |
| 4,594,753 | 6/1986 | Yoshida et al. | 24/433 |
| 4,976,016 | 12/1990 | Takabutake | 24/433 |
| 5,412,849 | 5/1995 | Fudaki | 24/433 X |
| 5,586,370 | 12/1996 | Fudaki | 24/433 |
| 5,638,585 | 6/1997 | Mizuno | 24/433 |

FOREIGN PATENT DOCUMENTS

| | | | |
|---|---|---|---|
| 0 581 319 | 2/1994 | European Pat. Off. . | |
| 0 704 177 | 4/1996 | European Pat. Off. . | |
| 2 722 956 | 2/1996 | France . | |
| 2115383 | 12/1971 | Germany | 24/433 |
| 395 031 | 2/1954 | Switzerland . | |

*Primary Examiner*—Anthony Knight
*Assistant Examiner*—Robert J. Sandy
*Attorney, Agent, or Firm*—Hill & Simpson

[57] ABSTRACT

In a separable bottom stop assembly of a concealed slide fastener, U-shaped guide portions are respectively connected continuously to ends of inner side edge of a box pin and a separable pin both in a shape of a prism for guiding flanges of the box having at a front face thereof an opening portion. Flat support portions are connected continuously to outsides of the guide portions, and the guide portions and the support portions made of thermoplastic resin are integrally molded to bottom ends of fastener stringer tapes. The guide portions and the support portions connected continuously to the box pin and the separable pin are thin at their portions where the box is disposed and thick at their portions outside the thin portions. The thick portions of the support portions extend to one-side faces of the fastener tapes. The box pin can be inserted into and fixed to a box-pin-insertion hole of the box. Therefore, the attaching portion of the separable bottom stop assembly is reinforced, and the attaching of the box and fitting and detaching operations of the separable pin can be easily performed.

14 Claims, 8 Drawing Sheets

SEPARABLE BOTTOM STOP ASSEMBLY OF CONCEALED SLIDE FASTENER

BACKGROUND OF THE INVENTION

1. Field of the Invention

The present invention relates to a separable bottom stop assembly composed of a box, a box pin, and a separable pin, which is attached to one end portion of a fastener chain of a concealed slide fastener, for opening a closed fastener chain by separating it into left and right fastener stringers, and closing the opened fastener chain. The box are attached to the box pin after the fastener stringers are attached to an object onto which the fastener chain is to be attached.

2. Description of the Related Art

Conventionally, there is a known separable bottom stop assembly for a concealed slide fastener which is composed of a box, a box pin, and a separable pin. In order to assemble the separable bottom stop assembly, left and right fastener stringers are sewn to an object to which the slide fastener is to be attached, with a slider and the box are detached therefrom, then the slider is fitted onto the fastener stringer having the box pin from a side of the box pin. Thereafter, the box is inserted onto the box pin attached onto an end portion of the fastener striger, and finally, the box is fixedly secured to the box pin. Such an separable bottom assembly for a concealed slide fastener is disclosed in Japanese Patent Application Laid-open Nos. 6-46906 and 6-245806.

In production of such a conventionally known concealed slide fastener having a separable bottom stop assembly composed of a box, a box pin, and a separable pin, or a separable bottom stop assembly of the concealed slide fastener described in the previous paragraph, the box pin and the separable pin made of thermoplastic resin are attached and molded directly to inner longitudinal side edges of the fastener stringer tapes respectively by injection molding means. Or alternatively, the box pin and the separable pin made of thermoplastic resin may be attached and molded directly onto the inner longitudinal edges by injecting molding means after reinforcing opposited end portions of the stringer tapes by sticking or fusing reinforcing films made of thermoplastic resin onto the end portions of the stringer tapes, or after hardening the end portions of the stringer tapes by making thermoplastic resin liquid such as polyester and polyurethane penetrate the end portions of the stringer tapes, and then heat molding the end portions.

Therefore, the stringer tapes in the vicinity of the mounted box pin and separable pin are too soft or easily deformed. As a result, attaching, i.e. molding of the box and the box pin by the molding means is troublesome. Further, attaching of the box to the box pin is unstable and troublesome. Also, an attaching portion of the separable pin tends to be easily deformed when the slide fastener is used for a long time after mounting of the box. It is difficult or extremely troublesome especially in the concealed slide fastener to appropriately fit and detach the separable pin to and from the box.

SUMMARY OF THE INVENTION

The present invention has been accomplished with the above problems in view. So, it is a main object of the invention to provide a separable bottom stop assembly of a concealed slide fastener composed of a box, a box pin, and a separable pin, wherein opposed end portions of fastener stringer tapes are reinforced by thermoplastic resin, the box pin and the separable pin which are easy to handle are integrally molded, the box can be easily and reliably attached to the stringer tapes, and an attaching portion of the separable pin is not deformed, so that fitting and detaching operations of the separable pin can be reliably performed for a long time.

It is also an object of the invention to provide a separable bottom stop assembly of a concealed slide fastener, wherein the end portions of the stringer tapes are reinforced so that the separable bottom stop assembly can be resistant to a use for a long time and is easy to handle.

Further, it is an object of the invention, to provide a separable bottom stop assembly of a concealed slide fastener, wherein the box is easy to handle and separating and fitting operation can be easily performed, by specifying a form of the box.

Furthermore, it is an object of the invention to provide a separable bottom stop assembly of a concealed slide fastener, wherein the box can be firmly and reliably fitted to the box pin thereby facilitating the separating and fitting operation by specifying a form of attaching the box pin to the box.

Still further, it is an object of the invention to provide a separable bottom stop assembly of a concealed slide fastener, wherein the separable pin can be attached to the stringer tape in a stable state, the separable pin can be easily fitted and detached to and from the box, and such a firmly fitted state can be maintained, by specifying a form of a vicinity where the separable pin is attached.

Still further, it is an object of the invention to provide a separable bottom stop assembly of a concealed slide fastener, wherein the box pin can be more reliably and easily attached to the box and the locked and fixed state can be maintained for a long time, by specifying corresponding forms of the box and the box pin.

Finally, it is an object of the invention to provide a strong separable bottom stop assembly of a concealed slide fastener, wherein the box can be easily locked and fixed and attached to the box pin in a stable state so that the box is not tottered for a long time, by specifying a form of an outside face of the box pin.

In order to achieve the above objects, according to the invention stated in claim 1, there is provided a separable bottom stop assembly of a concealed slide fastener including a box, a box pin, and a separable pin made of thermoplastic resin, wherein horizontal U-shaped guide portions each have a side wall which are respectively connected continuously to an end of inner side edges of the box pin and the separable pin both in a shape of a prism for guiding flanges of the box having at a front face thereof an opening portion, flat support portions are integrally connected continuously to outsides of the guide portions, the guide portions and the support portions are integrally molded with the box pin or the separable pin with thermoplastic resin and connected to bottom ends of fastener stringer tapes, in such a manner that the box pin can be inserted into and fixed to a box-pin-insertion hole formed in the box, and the box is mounted after the attaching of the pins are completed.

It is preferable that the horizontal U-shaped guide portions and the flat support portions continuously connected to the box pin and the separable pin are formed to be thin at portions thereof where the box is disposed and to be thick at portions thereof outside the thin portions, and the thick portions of the support portions extend to and are fixed to faces, i.e., front surfaces of the fastener stringer tapes.

Further, it is preferable that the box has a length larger than lengths of the horizontal U-shaped guide portions and lengths of the thin portions of the support portions and shorter than lengths of the box pin and the separable pin.

Further preferably, the box pin may be inserted into the box-pin-insertion hole provided to one side of the box, such that the box pin can be locked and fixed to the box.

Alternatively, the box pin may be inserted into the box-pin-insertion hole provided to one side of the box, such that the box pin can be fused and fixed to the box.

It is preferable that the separable pin has at one end thereof a sloping inner side surface, and the horizontal U-shaped guide portion which has the side wall continuous to the end of the inner side edge of the separable pin has a notch portion formed by notching an end portion of the side wall, the flange of the opening portion provided to a front surface of the box being inserted into the notch portion.

Further preferably, the box opens at a center of the front surface thereof to form the opening, and has at a center of a back wall thereof a tongue-like partitioning portion, the tongue-like partitioning portion having a hook-shaped engaging portion projecting from an end of the partitioning portion toward the box-pin-insertion hole, and the box pin has at an inside outer face thereof a projecting resilient portion having a resiliency so as to be engaged with the engaging portion of the partitioning portion of the box.

Furthermore, it is preferable that the box pin has, at a base portion of the resilient portion thereof, a projecting portion projecting inwardly to be in abutment with the partitioning portion of the box, and at the inner side surface, a flat-face projecting portion at a distance corresponding to a length of the engaging portion of the partitioning portion from the resilient portion, so that the flat-face projection portion can be in abutment with the separable pin.

DESCRIPTION OF THE PREFERRED EMBODIMENTS

Embodiments of a separable bottom stop assembly of a concealed slide fastener according to the present invention will be described in detail, with reference to the drawings.

Figure 1:
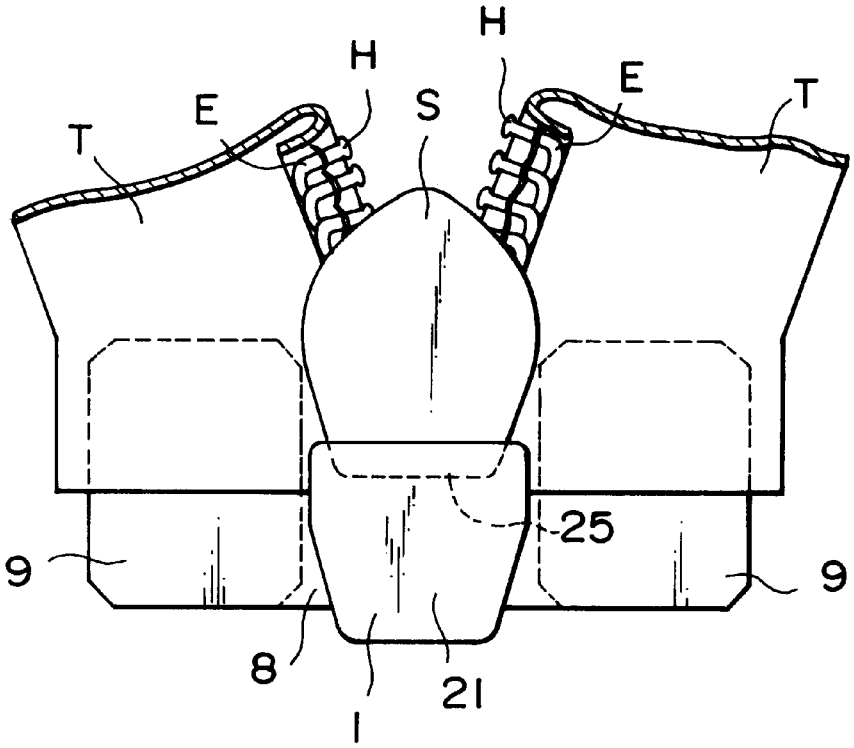
FIG. 1 is a back view of a separable bottom stop assembly of a concealed slide fastener according to this invention.
Figure 2:
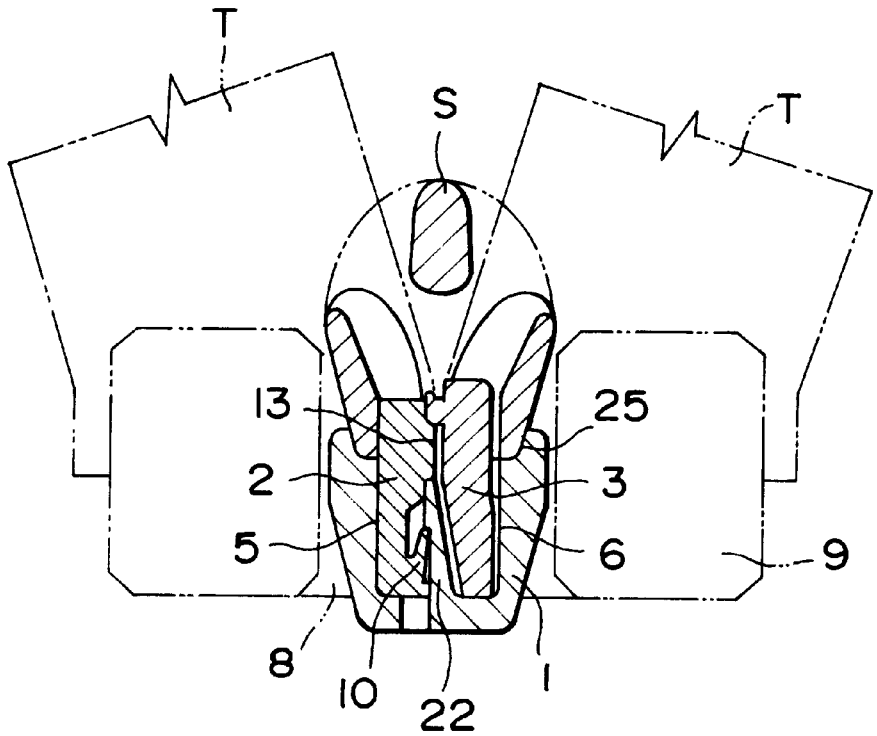
FIG. 2 is a plan view, partly in cross section, of the separable bottom stop assembly of the concealed slide fastener.
Figure 3:
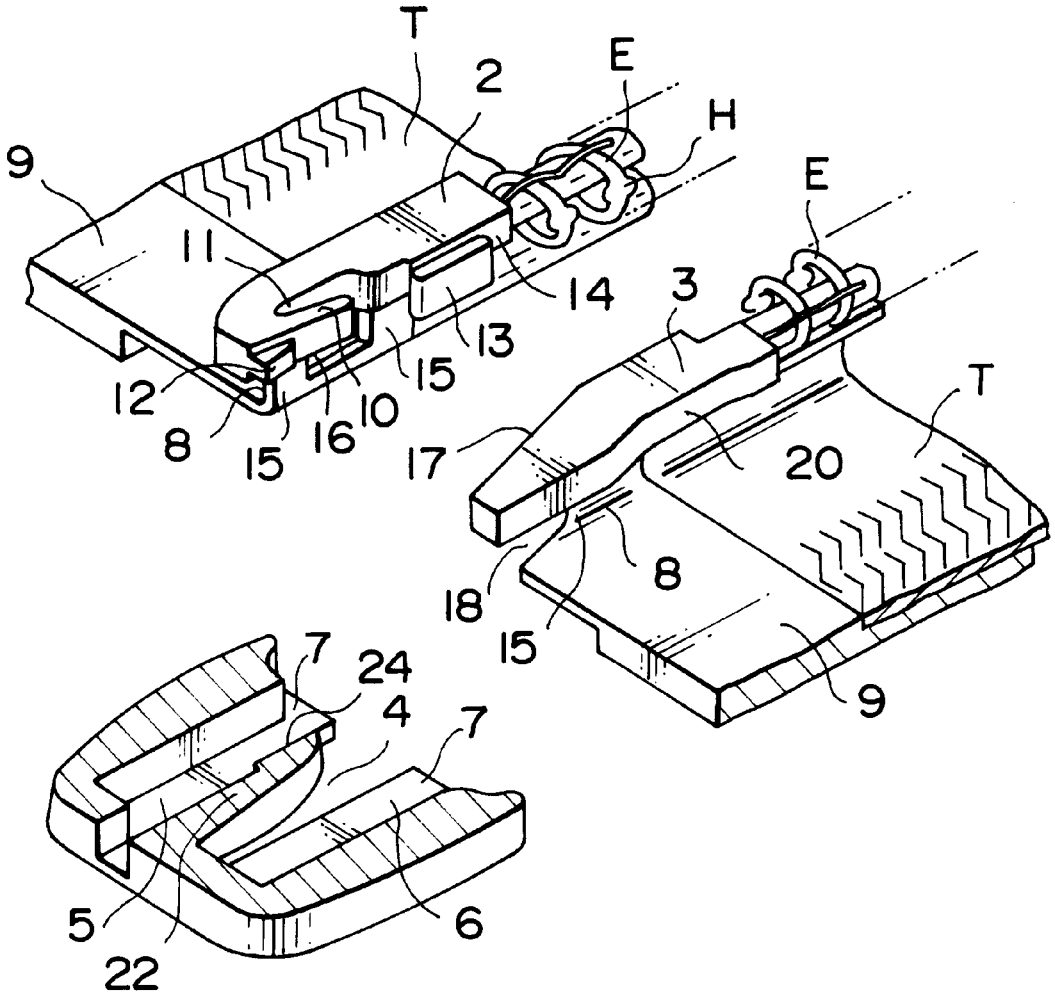
FIG. 3 is an exploded perspective view showing in cross section a part of the separable bottom stop assembly of the concealed slide fastener.

As shown in FIGS. 1 to 3, the separable bottom stop assembly of the concealed slide fastener according to the invention comprises three members, i.e., a box 1, a box pin 2, and a separable pin 3. The box 1, the box pin 2, and the separable pin 3 are respectively molded integrally by injection molding means or extrusion molding means using thermoplastic resin such as polyamide, polyacetals, polypropylene, and polybutylene terephthalate. The box pin 2 and the separable pin 3 are substantially in a shape of a prism and attached integrally to inner longitudinal edges of stringer tapes T, and connected continuously to fastener elements E attached to the side edges of the fastener stringer tapes T. The box 1 has an opening portion 4 at its front surface, and on its left and right sides, a box-pin-insertion hole 5 and a separable-pin-insertion hole 6. The box 1 is produced independently and is slidably fitted onto the box pin 2 attached to one of the stringer tapes T, thereby completing the separable bottom stop assembly.

As shown in FIG. 3, coiled fastener elements E made of thermoplastic synthetic fiber monofilament are sewn to a surface of the inner longitudinal edge of the fastener stringer tapes T folded in a U-shape, in such a manner that a meshing head portion H of each the fastener element E is disposed on an edge portion of the folded stringer tape T. Then, the box pin 2 is attached by integral molding continuously to the fastener elements E. The separable pin 3 is also attached to an inner longitudinal edge of a folded stringer tape T similarly to the box pin 2. The fastener elements E may be ones of a zigzag type or separate type, and may be made of metal.

Figure 6:
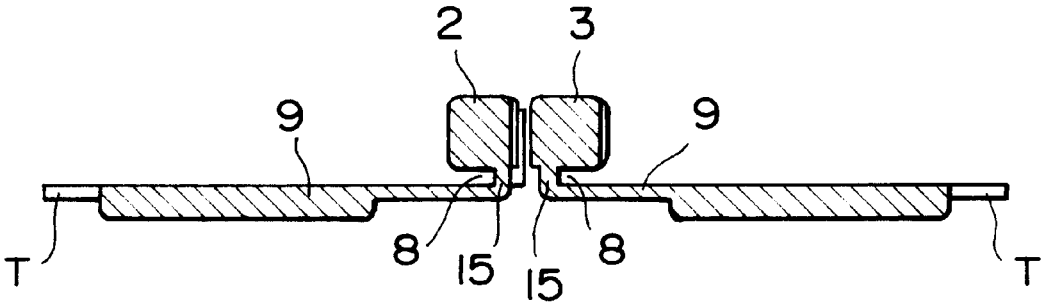
FIG. 6 is a sectional view taken along a line B—B in FIG. 4.
Figure 7:
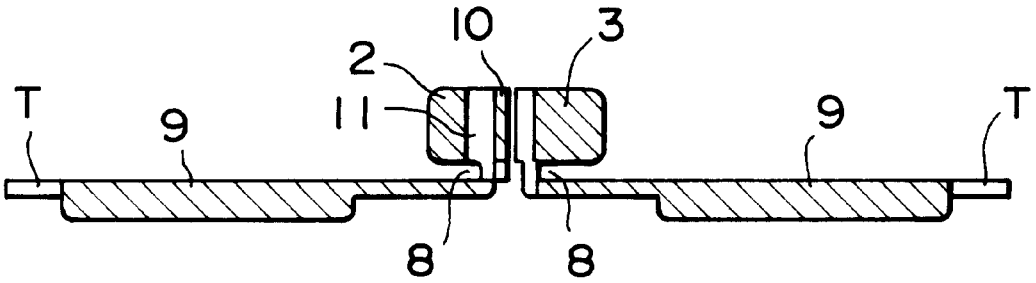
FIG. 7 is a sectional view taken along a line C—C in FIG. 4.
Figure 8:
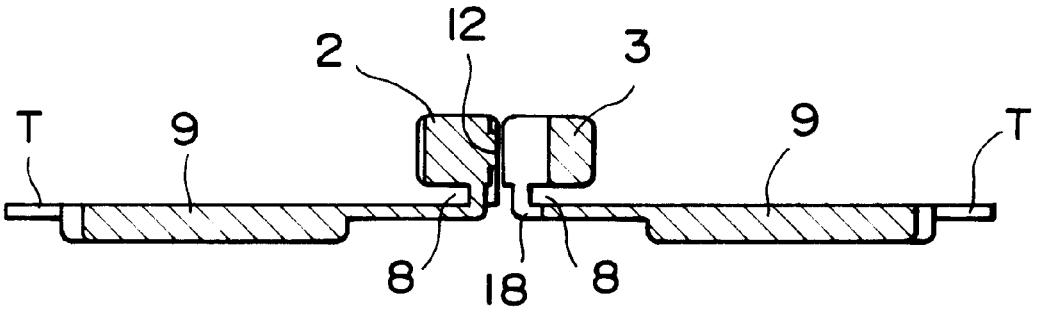
FIG. 8 is a sectional view taken along a line D—D in FIG. 4.
Figure 9:
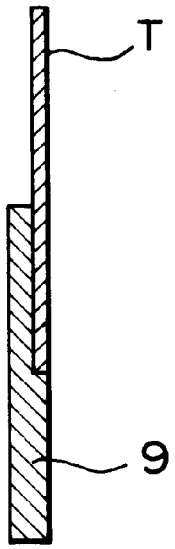
FIG. 9 is a sectional view taken along a line E—E in FIG. 4.

As shown in FIGS. 6, 7, and 8, the box pin 2 is connected continuously to an edge portion side, i.e., an inner edge of the folded stringer tape T so as to be in a shape of a key, in such a manner a U-shaped guide portion 8 having a side wall 15 is formed between the stringer tape T and the box pin 2 and is integrally molded with thermoplastic resin. As shown in FIGS. 6, 7, and 8, another guide portion 8 is formed between the other stringer tape T and the separable pin 3 and has a side wall 15 which is connected continuously to an edge portion side, i.e., an inner edge of the other folded stringer tape T, and is integrally molded with thermoplastic resin. The guide portions 8 formed on both the stringer tapes T guide flange portions 7 of the opening portion 4 formed in the front surface of the box 1.

Support portions 9 are integrally molded on outsides of both of the horizontal U-shaped guide portions 8 with thermoplastic resin. As shown in FIG. 3, the guide portions 8 and the support portions 9 are formed at bottom end portions of the stringer tapes T. Also, the guide portions 8 and the support portions 9 are molded to be thin at their portions to which the box 1 is fitted, and the support portions 9 are molded to be thick at their portions outside the thin portions thereof. Sides of the support portions 9 facing the stringer tapes T extend to reach the front surfaces of the stringer tapes T while maintaining its thickness and are fixed to the stringer tapes T by fusing. The thick portions of the support portions 9 extend further than the box pin 2 and the separable pin 3 on the stringer tapes T, thereby reinforcing the end portions of the stringer tapes T so that the separable pin 3 can be smoothly fitted to and detached to and from the box 1.

The box pin 2 has, at its inside lower end, a resilient portion 10 having resiliency and protecting in a shape of a hook. A recessed plunge portion 11 is provided at an inside of the resilient portion 10 to allow the resilient portion 10 to be resiliently deformed easily. The resilient portion 10 has at its lower end base portion a small projecting portion 12 to be pressed into the box-pin-insertion hole 5 provided to the box 1. A flat-face projecting portion 13 projecting inwardly is provided to the inner side surface of the box pin 2 above the resilient portion 10 at a distance from the resilient portion 10 corresponding to a size of an engaging portion 24 of a partitioning portion 22 provided to the box 1. The flat-face projecting portion 13 can be brought into abutment with the opposed separable pin 3. A recess portion 14 is formed above the flat-face projecting portion 13 with a difference in levels of the flat-face projecting portion 13 and the recess portion 14. An upper end of the box pin 2 is connected to the coiled fastener element E in such a manner that a lower end portion of the fastener element E is recessed therein. A side wall 15 of the guide portion 8 connected to the inner side end of the box pin 2 is provided with an opening portion 16.

As shown in FIG. 3, the separable pin 3 is also formed in a shape of the prism and is continuously connected to the coil-shaped fastener elements E attached to an inner longitudinal edge of the other one of the folded stringer tapes. The separable pin 3 has at its inner side surface a slope portion 17 that is thinner toward its lower end, thereby allowing smooth insertion of the separable pin 3 into the box 1. As apparent from FIGS. 3 and 4, the guide portion 8 connected continuously to the end of the inner side edge of the separable pin 3 has a notch portion 18 formed by notching an end of its side wall 15 parallel to the sloping portion 17 of the separable pin 3. Therefore, the guide portion 8 facilitates smooth movement of the box 1 along either of the flanges 7 formed on the box 1.

Figure 4:
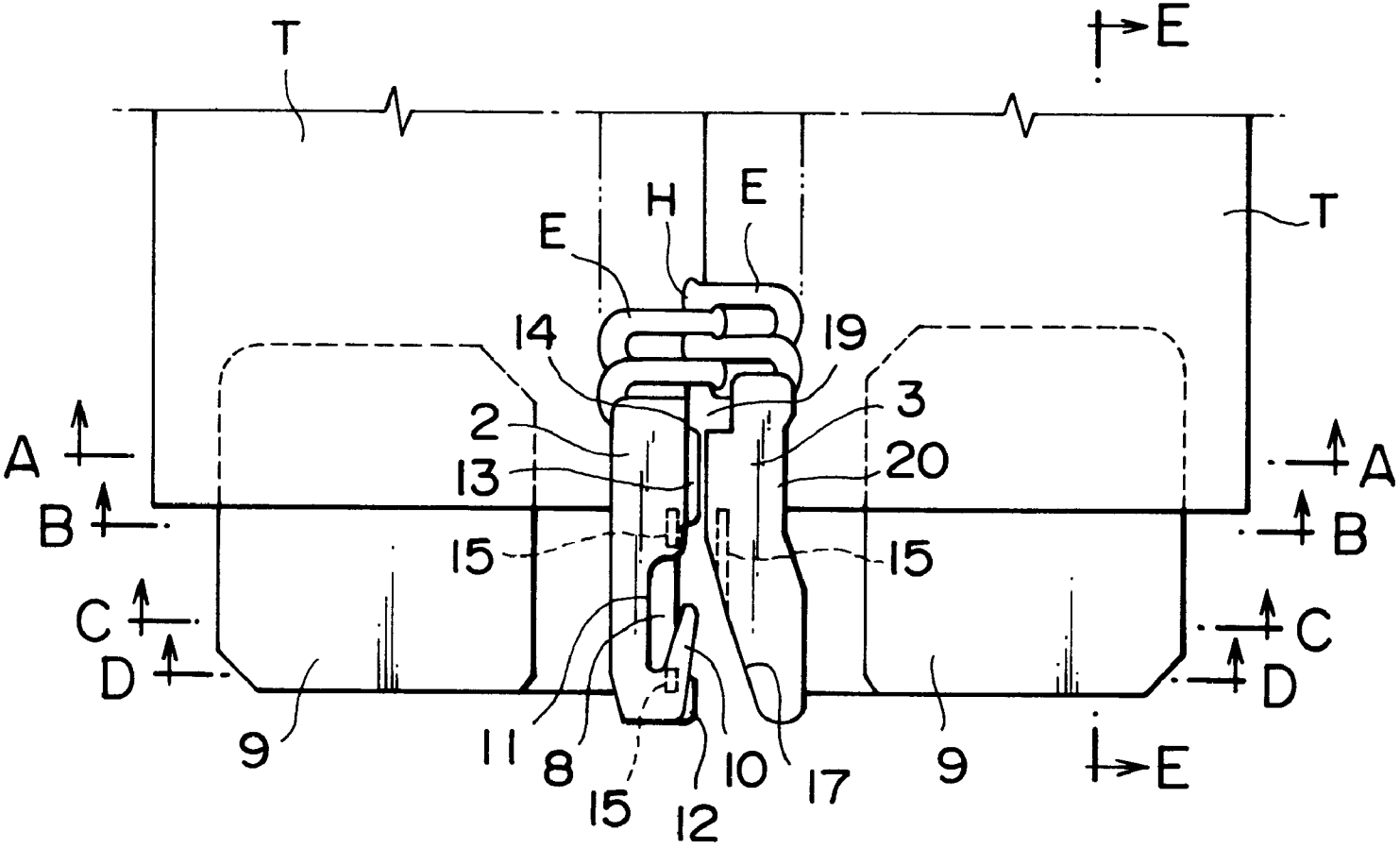
FIG. 4 is a back view of the separable bottom stop assembly of the concealed slide fastener with a box detached.
Figure 5:
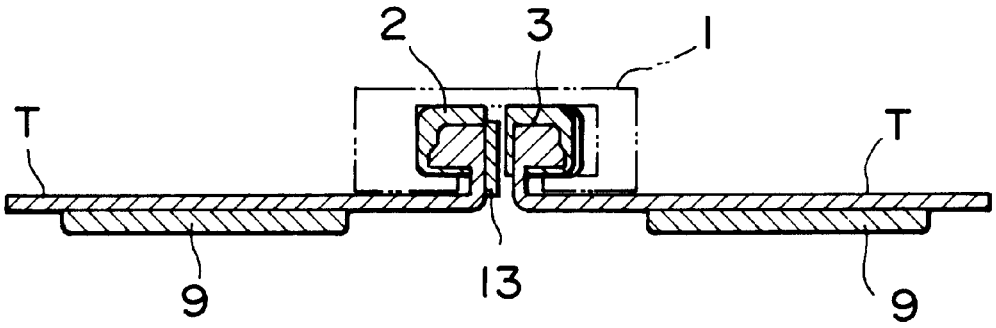
FIG. 5 is a sectional view taken along a line A—A in FIG. 4.

As shown in FIGS. 2 and 4, the separable pin 3 is longer than the box pin 2 and has, at an upper portion of the inner side surface of the separable pin 3, a small hook portion 19 to be in abutment with and facing the recess portion 14 of the box pin 2 and meshed with the lowest one of the coiled fastener elements E. The separable pin 3 has, it an outer side surface thereof, a curved recessed face 20 so that the separable pin 3 can be smoothly inserted and set in a slider S and the box 1.

Figure 10:
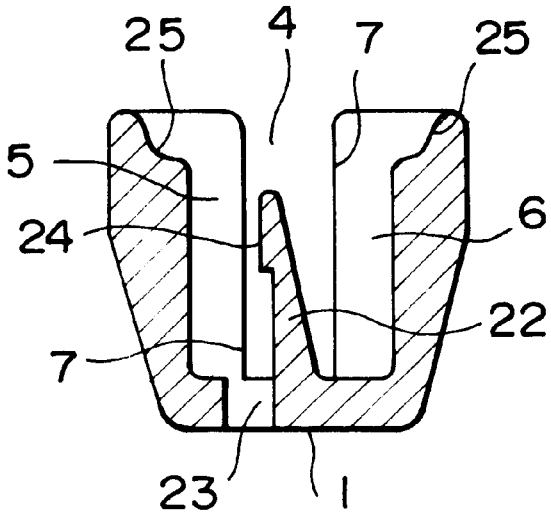
FIG. 10 is a cross-sectional plan view of a box of the separable bottom stop assembly of the concealed slide fastener.

As shown in FIGS. 1 and 10, the box 1 has, at a center of the front face thereof, the longitudinal opening portion 4, and at its left and right sides, the flanges 7. The box 1 further has, at a center of a back wall 21 of the box 1, the tongue-like partitioning portion 22, and on left and right sides of the partitioning portion 22, the box-pin-insertion hole 5 and the separable-pin-insertion hole 6. The separable-pin-insertion hole 6 has a bottom, while the box-pin-insertion hole 5 has a through hole 23 at its bottom for facilitating the molding of the partitioning portion 22, especially the engaging portion 24 projecting in a shape of a hook from an end of the partitioning portion 22 toward the box-pin-insertion hole 5. The engaging portion 24 is fitted between the resilient portion 10 and the flat-face projecting portion 13 of the box pin 2 to firmly fix the box pin 2 and the box 1. The partitioning portion 22 has a base portion sloping so as to be gradually thicker toward the bottom of the base portion. The partitioning portion 22 can be in abutment with the sloping portion 17 of the separable pin 3.

The box 1 has at its upper surface a hollow portion 25 into which the slider S is fitted and which holds the slider S. Therefore, the slider S can be held in a stable state and moved smoothly in operation.

The separable bottom stop assembly composed of the box 1, the box pin 2, and the separable pin 3 are assembled as described below. After sewing the stringer tape T, to which the box pin 2 is attached, to an edge portion of one of the sides of an object to which a concealed slide fastener chain is attached, the slider S is inserted through the box pin 2. Then, the box 1 is mounted to the box pin 2 by inserting its flanges 7 into the guide portions 8 via the opening portion 4 and resiliently fitting the engaging portion 24 of the partitioning portion 22 between the resilient portion 10 and the flat-face projecting portion 12, thereby completing the assembling of the separable bottom stop assembly. After inserting the separable pin 3, which is attached to the stringer tape T sewn on an edge portion of the other side of the article, into the slider S and the separable-pin-insertion hole 6 of the box 1, the slider S is pushed up to mesh the opposite coiled fastener elements E attached to the left and right stringer tapes T with each other, thereby closing the fastener chain. The slider S is pushed down to detach the separable pin 3 from the box 1 and the slider S, thereby separating and opening the fastener chain.

Figure 11:
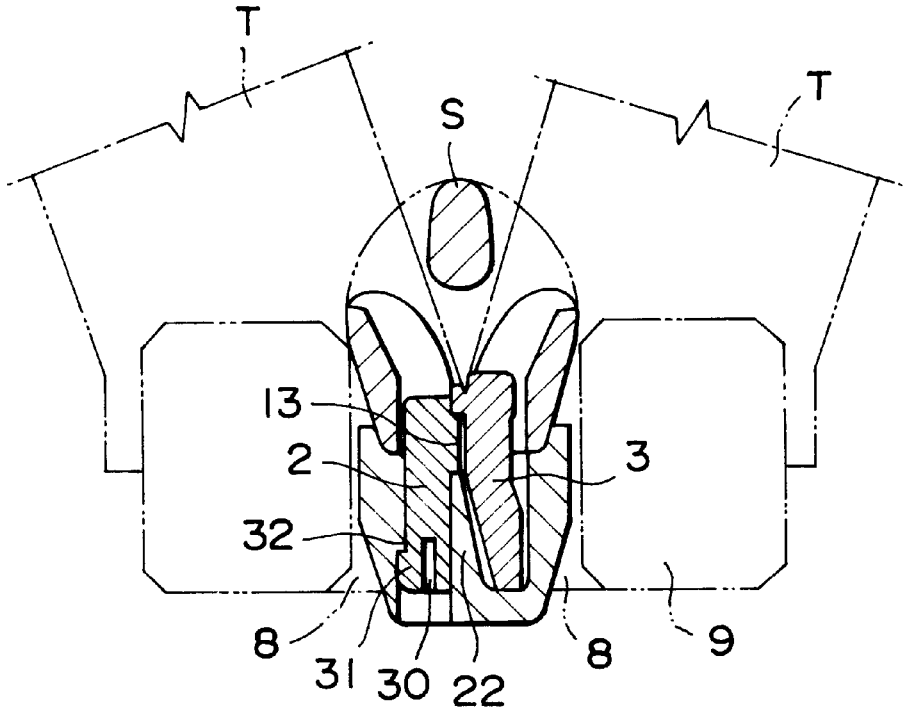
FIG. 11 is a cross-sectional plan view of a separable bottom stop assembly according to a second embodiment.
Figure 12:
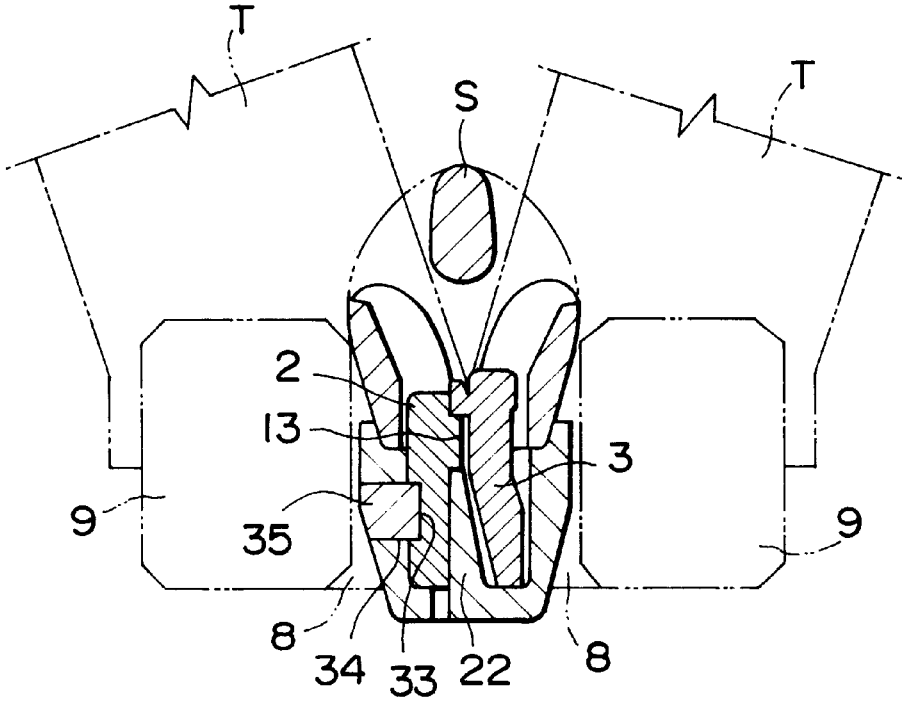
FIG. 12 is a cross-sectional plan view of a separable bottom stop assembly according to a third embodiment.
Figure 13:
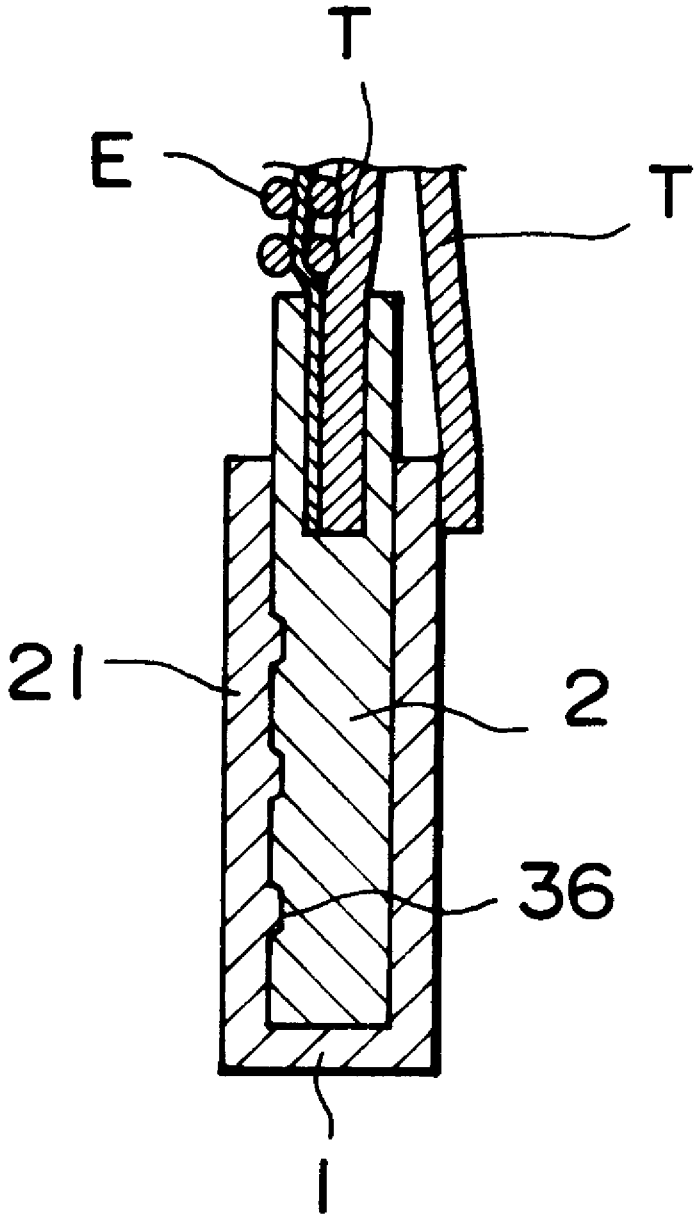
FIG. 13 is a vertical sectional view of a separable bottom stop assembly according to a fourth embodiment.

FIGS. 11 to 13 show examples of locking states of the box 1 and the box pin 2. The embodiment shown in FIG. 11 is identical with the above-described embodiment except that the box pin 2 in the shape of the prism has at its end a recessed groove 30 for applying a resilience to the box pin 2, and a locking portion 31 projecting from the outer side surface of the box pin 2 to be engaged with a locking projecting portion 32 formed on a side wall surface of the box-pin-insertion hole 5 of the box 1.

The example shown in FIG. 12 is identical with the above first embodiment except that the box pin 2 in the shape of the prism has at a center of its side surface an angular recess portion 33, and the box-pin-insertion hole 5 of the box 1 has at its side wall a through hole 34 which corresponds to the recess portion 33 of the box pin 2. After inserting the box pin 2 into the box 1, a locking member 35 is forced and locked into the through hole 34 of the box 1.

The example shown in FIG. 13 is identical with the first embodiment except that the box pin 2 in the shape of the prism has on its back surface a plurality of recess portions 36, and after the box pin 2 is inserted into the box-pin-insertion hole 5 in the box 1, a back wall 21 of the box 1 and the recess portion 36 of the box pin 2 are fused and fixed to each other by heating and pressing the back wall 21 of the box 1 from outside. The box pin 2 and the box 1 may be locked to each other in known manners other than the above-mentioned embodiments.

The separable bottom stop assembly of the concealed slide fastener according to the present invention having the above-described structure has the following effects.

According to the invention, the guide portions 8 for guiding the flanges 7 of the box 1 having the opening portion 4 at the front face of the box 1 have side walls 15 which are respectively connected to the ends of the inner side edges of the prism-shaped box pin 2 and separable pin 3. The support portions 9 are connected continuously to the outsides of the guide portions 8, and the guide portions 8 and the support portions 9 are integrally molded to the ends of the stringer tapes T in such a manner that the box pin 2 can be inserted into and fixed to the box 1. Therefore, it is possible to easily reinforce the stringer tapes T and integrally mold the reinforced portion and the box pin 2 or the separable pin 3, thereby increasing a productivity of the separable bottom stop assembly. Furthermore, since the separable bottom stop assembly is strong and not deformed, it is possible to easily achieve the separable bottom stop assembly which has desirable operability, is resistant to a use for a long time, and easy to handle. Thus, the box 1 can be attached afterward.

Further, the guide portions 8 and the support portions 9 connected continuously to the box pin 2 and the separable pin 3 are formed to be thin at their portions to which the box 1 is attached and to be thick at their portions outside the thin portions, and the thick portions of the support portions 9 extend to the front surfaces of the stringer tapes T. Therefore, it is possible to easily attach the box 1 to the box pin 2, and smoothly fit and detach the separable pin 3 to and from the box 1. Furthermore, since the support portions 9 are hardly peeled off or detached from the stringer tapes T, the separable bottom stop assembly is resistant to a use for a long time.

Furthermore, the box 1 has a length larger than lengths of the guide portions 8 connected continuously to the box pin 2 and the separable pin 3 and the thin support portions 9 onto which the box 1 is disposed and has a length smaller than lengths of the box pin 2 and the separable pin 3. Therefore, the box 1 can be easily and reliably attached to the stringer tapes T, and the separable pin 3 is easy to handle.

Still further, the box pin 1 is inserted into the box-pin-insertion hole 5 formed in one side of the box 1 so that the box pin 1 can be fixed by locking or fusing. The box pin 1 is suitable for the separable bottom stop assembly with the box 1 attached afterward, and the box pin 2 and the box 1 can be easily fixed to each other by simple fixing means.

Still further, the separable pin 3 has a sloping portion 17 at it inner side surface, and the side wall 15 of the guide portion 8 is continuous to the ends of the inner side edge of the separable pin 3 and has a notch portion 18 formed by notching the side wall end portion of the guide portion 8 so that the flange 7 of the box 1 can be inserted into the notch portion 18. Therefore, when the separable bottom stop assembly is used in a closed state, the separable pin 3 can be held in the box 1 in a remarkably stable state.

Still further, the box 1 has at its center a tongue-like partitioning portion 22, and the tongue-like partitioning portion has a hook-shaped engaging portion 24 projecting from the end of the partitioning portion 22 toward the box-pin-insertion hole 5, and the box pin 2 has at its inner side surface a resilient portion 10 having resiliency so as to to be engaged with the engaging portion 24. Therefore, the box 1 can be remarkably smoothly and easily attached and fixed to the box pin 2.

Finally, the box pin 2 has, at the base portion of the resilient portion 10 projecting from the box pin 2, a projecting portion 12 projecting inwardly to be in abutment with the partitioning portion 22. The box pin 2 also has, at the inner side surface of the box pin 1 above an end of the resilient portion 10, a flat-face projecting portion 13 at a distance corresponding to the size of the engaging portion 24 of the partitioning portion 22 from the resilient portion 10, so that that the flat-face projecting portion 13 can be in abutment with the separable pin 3. Therefore, the box 1 can be firmly fixed to the box pin 2 without tottering, and the strong separable bottom stop assembly can be obtained.

What is claimed:

1. A separable bottom stop assembly of a concealed slide fastener composed of a box having an opening portion at a front face thereof, a box pin, and a separable pin made of thermoplastic resin, wherein non-deformable horizontal U-shaped guide portions for guiding flanges of the box each have a side wall respectively connected continuously to ends of inner side edges of the box pin and the separable pin, and flat support portions are connected continuously to outsides of the guide portions, the guide portions and the support portions made of thermoplastic resin are integrally molded with bottom ends of fastener stringer tapes in such a manner that the box pin can be inserted into and fixed to a box-pin-insertion hole of the box.

2. A separable bottom stop assembly of a concealed slide fastener according to claim 1, wherein the guide portions and the support portions are formed to be thin at portions thereof where the box is disposed, and the support portions are formed to be thick at portions thereof outside the thin portions, and the thick portions of the support portions extend to and are fixed to one-side surfaces of the fastener stringer tapes.

3. A separable bottom stop assembly of a concealed slide fastener according to claim 2, wherein the box has a length larger than lengths of the guide portions and lengths of the thin portions of the support portions where the box is disposed and shorter than lengths of the box pin and the separable pin.

4. A separable bottom stop assembly of a concealed slide fastener according to claim 1, 2 or 3, wherein the box pin is inserted into the box-pin-insertion hole provided to one side of the box, in such a manner the box pin can be locked and fixed.

5. A separable bottom stop assembly of a concealed slide fastener according to claim 1, 2 or 3, wherein the box pin is inserted into the box-pin-insertion hole provided to one side of the box, in such a manner that the box pin can be fused and fixed.

6. A separable bottom stop assembly of a concealed slide fastener according to claims 1, 2, or 3, wherein the separable pin has a sloping inner side surface, and the side wall of the U-shaped guide portion connected to the inner side edge of the separable pin has a notch portion so that the flange of the box can be inserted into the notch portion.

7. A separable bottom stop assembly of a concealed slide fastener according to claim 4, wherein the box has at a center thereof a tongue-like partitioning portion having a hook-shaped engaging portion projecting from an end thereof toward the box-pin-insertion hole, and the box pin has at an inner side surface thereof a projecting resilient portion having a resiliency to be engaged with the engaging portion.

8. A separable bottom stop assembly of a concealed slide fastener according to claim 7, wherein the box pin has, at a base portion of the resilient portion thereof, a projecting portion projecting inwardly to be in abutment with the partitioning portion, and at the inner side surface thereof above the resilient portion, a flat-face projecting portion at a distance corresponding to a length of the engaging portion of the partitioning portion from the resilient portion so that the flat-face projecting portion can be in abutment with the separable pin.

9. A separable bottom stop assembly of a concealed slide fastener according to claim 1, wherein the box has a length larger than lengths of the guide portions and lengths of thin portions of the support portions where the box is disposed and shorter than lengths of the box pin and the separable pin.

10. A separable bottom stop assembly of a concealed slide fastener according to claim 9, wherein the separable pin has a sloping inner side surface, and the side wall of the U-shaped guide portion connected to the inner side edge of the separable pin has a notch portion so that the flange of the box can be inserted into the notch portion.

11. A separable bottom stop assembly of a concealed slide fastener according to claim 9, wherein the box pin is inserted into the box-pin-insertion hole provided to one side of the box, in such a manner that the box pin can be fused and fixed.

12. A separable bottom stop assembly of a concealed slide fastener according to claim 9, wherein the box pin is inserted into the box-pin-insertion hole provided to one side of the box, in such a manner the box pin can be locked and fixed.

13. A separable bottom stop assembly of a concealed slide fastener according to claim 12, wherein the box has at a center thereof a tongue-like partitioning portion having a hook-shaped engaging portion projecting from an end thereof toward the box-pin-insertion hole, and the box pin has at an inner side surface thereof a projecting resilient portion having a resiliency to be engaged with the engaging portion.

14. A separable bottom stop assembly of a concealed slide fastener according to claim 13, wherein the box pin has, at a base portion of the resilient portion thereof, a projecting portion projecting inwardly to be in abutment with the partitioning portion, and at the inner side surface thereof above the resilient portion, a flat-face projecting portion at a distance corresponding to a length of the engaging portion of the partitioning portion from the resilient portion so that the flat-face projecting portion can be in abutment with the separable pin.

* * * * *